US006988717B2

(12) United States Patent
Han

(10) Patent No.: US 6,988,717 B2
(45) Date of Patent: Jan. 24, 2006

(54) METHOD AND SYSTEM FOR NEAR SATURATION HUMIDIFICATION OF A GAS FLOW

(75) Inventor: Leon Han, San Jose, CA (US)

(73) Assignee: Chemflow Systems, Inc., San Jose, CA (US)

( * ) Notice: Subject to any disclaimer, the term of this patent is extended or adjusted under 35 U.S.C. 154(b) by 40 days.

(21) Appl. No.: 10/738,507

(22) Filed: Dec. 15, 2003

(65) Prior Publication Data

US 2005/0127540 A1 Jun. 16, 2005

(51) Int. Cl.
*B01F 3/04* (2006.01)

(52) U.S. Cl. ..... 261/128; 261/66; 261/130; 261/134; 261/137; 261/142; 261/DIG. 10

(58) Field of Classification Search ..... 261/58, 261/66, 128, 130, 131, 133, 134, 135, 137, 261/142, DIG. 10, DIG. 29, DIG. 32, DIG. 76
See application file for complete search history.

(56) References Cited

U.S. PATENT DOCUMENTS 3,952,181 A * 4/1976 Reed ..... 392/397
4,436,674 A * 3/1984 McMenamin ..... 261/64.3
4,705,936 A * 11/1987 Fowler ..... 392/326
4,711,294 A * 12/1987 Jacobs et al. ..... 165/230
4,909,436 A * 3/1990 Hamner et al. ..... 236/44 A
6,115,539 A * 9/2000 Cohn ..... 392/402
6,135,433 A * 10/2000 Nurmi ..... 261/128
6,182,951 B1 * 2/2001 Hallman et al. ..... 261/130
6,299,147 B1 * 10/2001 Mitter ..... 261/128
6,715,743 B2 * 4/2004 Zhang ..... 261/130
6,787,254 B2 * 9/2004 Cargnelli et al. ..... 429/13
6,863,268 B2 * 3/2005 Zhang ..... 261/130
2002/0110714 A1 * 8/2002 Andrews et al. ..... 429/24

* cited by examiner

*Primary Examiner*—Scott Bushey
(74) *Attorney, Agent, or Firm*—C. P. Chang; Joe Zheng

(57) ABSTRACT

A method and system of near saturation gas humidification by mixing a steam and a gas flow is disclosed. The steam is generated with a heating device at a controlled rate from a liquid contained in a vessel near the point of use of the humidified gas. The controlled rate results from a feedback loop that controllably heats the liquid while measuring the steam temperature and maintaining it around a set point. The humidification delivery rate is adjustable by adjusting the temperature set point and/or the gas pressure. Undesirable components from the humidified gas are removed with an in-line filter after its point of generation. Condensation from the humidified gas before its point of use is removed with a drain pipe in combination with a drain valve triggered by a condensation level sensor.

33 Claims, 2 Drawing Sheets

METHOD AND SYSTEM FOR NEAR SATURATION HUMIDIFICATION OF A GAS FLOW

BACKGROUND OF THE INVENTION

1. Field of the Invention

The present invention relates generally to the field of gas supply for a point of use. More particularity, the present invention concerns the generation and supply of gas of high humidity.

2. Description of the Related Art

Highly humidified, or near saturation, flow gases of variety are often required at a point of use such as a reaction chamber of a semiconductor wafer processing equipment. Some example gases are air, Nitrogen, Oxygen or an inert gas such as Argon. Typically, the required relative humidity is 90% and above. Such a high relative humidity of the flow gas, being near the point of condensation, is difficult to reach and maintain near a constant state. Many current humidification methods require large humidity contact surfaces and/or humidity contact time to reach near saturation. Some current example methods are:

1) Bubbling the flow gas through a liquid medium to gain humidity. The liquid medium can be water or a water containing solution.
2) Pressure techniques through a small orifice to spray and atomize the water into the flow gas.
3) Membranes with capillaries under pressure for separation of water into a mist for humidification of the flow gas.

Therefore, a compact, effective and fast acting method for near saturation humidification and control of a gas flow is desired.

SUMMARY OF THE INVENTION

The present invention provides a method and system of near saturation humidification of a gas flow by mixing a steam and a gas flow to reach a humidity level that is near the point of saturation. The mixing is done by injecting the steam into the gas flow or vice versa.

The injecting steam is generated with a heating device and with a controlled generation rate from a steam-generating liquid contained in a steam-generating vessel located in physical proximity to the point of use of the humidified gas flow.

The controlled generation rate is achieved with a feedback loop to controllably heat the steam-generating liquid while measuring the steam temperature with a thermocouple so as to maintain the temperature around a set point.

The humidification delivery rate is adjustably controllable by adjusting the above temperature set point and/or by adjusting the supply pressure of the gas flow.

A manifold device is connected to the steam-generating vessel for supplying the gas flow, supplying the steam-generating liquid, injecting steam into the gas flow and delivering the humidified gas flow to its point of use.

The undesirable components, other than the steam and the flow gas, are removed from the humidified gas flow with an in-line filter after its point of generation. Condensation from the humidified gas flow before its point of use is removed with a drain pipe in combination with a drain valve triggered by a condensation level sensor.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawing, in which like reference characters designate the same or similar parts throughout the several views, and wherein.

DETAILED DESCRIPTION OF THE PREFERRED EMBODIMENTS

In the following detailed description of the present invention, numerous specific details are set forth in order to provide a thorough understanding of the present invention. However, it will become obvious to those skilled in the art that the present invention may be practiced without these specific details. In other instances, well-known methods, procedures, materials, components and circuitry have not been described in detail to avoid unnecessary obscuring aspects of the present invention. The detailed description is presented largely in terms of simplified schematics. These descriptions and representations are the means used by those experienced or skilled in the art to concisely and most effectively convey the substance of their work to others skilled in the art.

Reference herein to "one embodiment" or an "embodiment" means that a particular feature, structure, or characteristics described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of process flow representing one or more embodiments of the invention do not inherently indicate any particular order nor imply any limitations of the invention.

The present invention of near saturation humidification of a gas flow proposes to generate and mix a steam with a gas flow to reach a humidity level that is near the point of saturation. The mixing of the steam and the gas flow can be accomplished by injecting the generated steam into the gas flow or vice versa.

Figure 1:
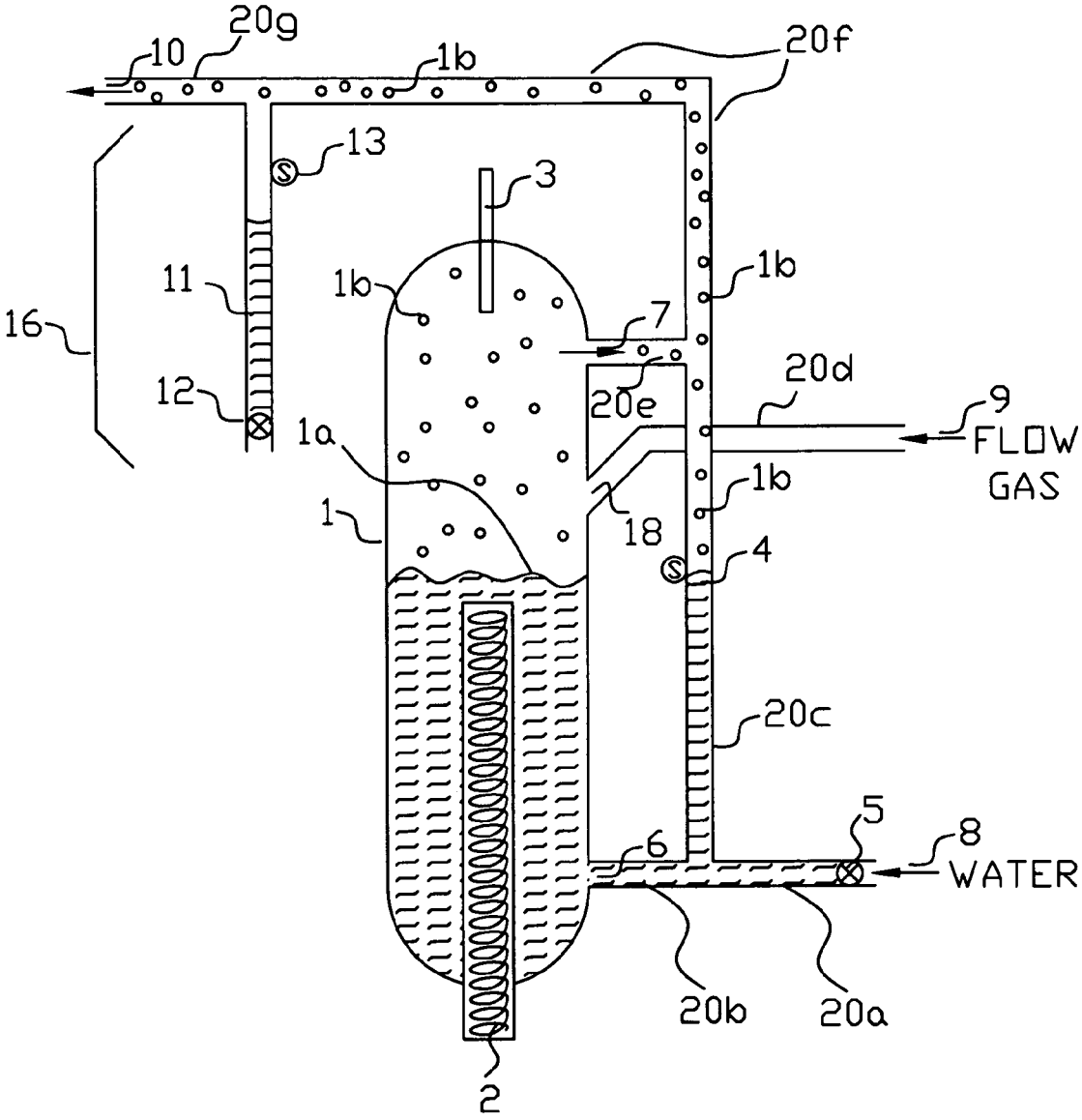
FIG. 1 illustrates an embodiment of the present invention method of near saturation humidification of a gas flow.

FIG. 1 illustrates a system embodiment of the present invention. A steam-generating vessel 1 holds water 1*a* used to generate a steam 1*b* when heated with an attached heating device 2. The steam-generating vessel 1 can be made of a housing canister. The heating device 2 can be designed as a replaceable heater cartridge for easy service replacement. Steam generation rate can be controlled, around a desired value, by a thermocouple 3 attached to the housing of the steam-generating vessel 1 for measuring the temperature of the generated steam 1*b*. The thermocouple 3 and the heating device 2 then form a feedback loop to controllably heat the water 1*a* while measuring the temperature of the generated steam 1*b* so as to maintain the steam temperature around a desired set point. An embodiment of simple control scheme is to use the set point of the thermocouple 3 to turn the heating device 2 off or on although more complex and accurate schemes known in the art such as proportional controls, etc. can be used as well. Notice that, for generality, the thermocouple 3 can alternatively be any one of a variety of temperature measuring devices.

A manifold device, including manifold sections 20*a*, 20*b*, 20*c*, 20*d*, 20*e*, 20*f* and 20*g*, is provided for connection to the steam-generating vessel 1 for supplying a flow gas 9 through a gas in-take port 18, for supplying water 1*a* through a feed line 8 via a liquid in-take port 6, for injecting thus mixing the steam 1*b* with the flow gas 9 and for delivering, via a humidified gas exit port 7, the humidified gas flow to its point of use through a port of use 10. Thus, the mixing of water 1*a* with flow gas 9 takes place both inside the steam-generating vessel 1 and within the manifold sections 20*e*, 20*f* and 20*g*. By now, for those skilled in the art, the humidification system of the present invention can also be characterized as injecting the flow gas 9 into the steam 1*b* causing the desired mixing action. Because the steam-generating vessel 1 can be made very compact in size, the injecting steam 1*b* can be located in physical proximity to the port of use 10 of the humidified gas flow thus realizing numerous advantages like reduction of heat loss, gas pressure loss and condensation. As a remark, the flow gas 9 can be made of air, Nitrogen or an inert gas. The water level within the steam-generating vessel 1 can be adequately maintained by a liquid level sensor 4, as part of the manifold device, that senses the water level within the steam-generating vessel 1 and turns a feed valve 5 along the feed line 8 off and on as appropriate.

The humidification delivery rate of the humidified gas flow from the port of use 10 can be controlled around an adjustable value by at least one or combination of the following:

a. adjusting the temperature set point of the steam 1*b*.

b. adjusting the supply pressure of the flow gas 9.

To remove condensation from the humidified gas flow before its port of use 10, a condensation removing device 16 is provided. The condensation removing device 16 includes a drain pipe 11 attached to the manifold device, in this case at manifold sections 20*f* and 20*g*, to receive its condensation between a point of steam generation and the port of use 10, a condensation level sensor 13 located with the drain pipe 11 for sensing the cumulated condensation level and a drain valve 12. Thus, when the cumulated condensation reaches a pre-determined level as sensed by the condensation level sensor 13, the condensation level sensor 13 would trigger and open the drain valve 12 to drain the condensation around its lowest point. Of course, the drain pipe 11 can be alternatively implemented as a collection vessel. Hence, the illustrated system embodiment of the present invention can reliably deliver a humidified gas flow with an adjustable flow rate while maintaining a relative humidity of 90% and above.

Figure 2:
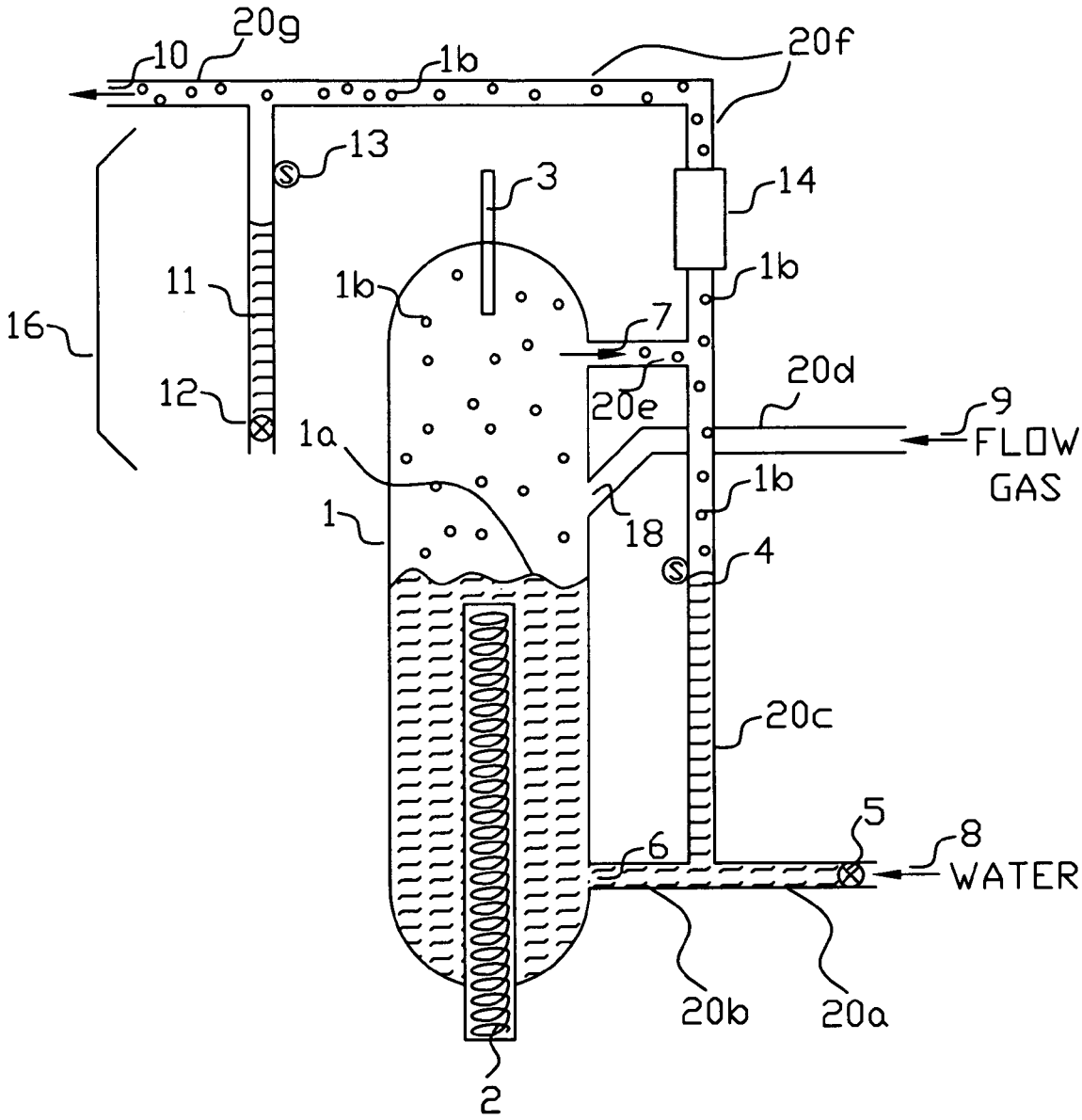
FIG. 2 illustrates a refinement of the embodiment of the present invention method of near saturation humidification of a gas flow.

FIG. 2 illustrates a refinement of the embodiment of the present invention method of near saturation humidification of a gas flow. An extraneous material removing device is provided for removing components, other than the desired steam and the desired flow gas, from the humidified gas flow after its point of generation. Examples of such extraneous material are large water droplets or simply impurity particles. In this embodiment, the extraneous material removing device is an in-line filter 14, located within the manifold section 20*f*, for passing the steam 1*b* and the flow gas 9 while blocking other extraneous materials from the humidified gas flow and allowing them to flow back to the water 1*a*.

As described with numerous exemplary embodiments, a method and system of near saturation humidification of a gas flow includes mixing a steam and a gas flow to reach a humidity level that is near the point of saturation. However, for those skilled in this field, these exemplary embodiments can be easily adapted and modified to suit additional applications without departing from the spirit and scope of this invention. Thus, it is to be understood that the scope of the invention is not limited to the disclosed embodiments. On the contrary, it is intended to cover various modifications and similar arrangements based upon the same operating principle. The scope of the claims, therefore, should be accorded the broadest interpretations so as to encompass all such modifications and similar arrangements.

What is claimed is:

1. A method of near saturation humidification of a gas flow, the method comprising:

generating steam in a chamber filled partially with steam-generating liquid up to a level controlled by an external sensor, wherein a heater is immersed in said steam-generating liquid;

causing said steam and a gas flow to be mixed to produce a humidified gas flow to be delivered via an exit port; and removing condensation from the humidified gas flow by a condensation removing device including a drain pipe and a condensation level sensor.

2. The method of claim 1, further comprising injecting said steam into said gas flow.

3. The method of claim 1, further comprising injecting said gas flow into said steam from a path bent towards said steam-generating liquid to maximize mixing said steam into said gas.

4. The method of claim 1, further comprising causing the humidified gas flow to pass through an in-line filter to remove any possible extraneous material from the humidified gas flow.

5. The method of claim 4, wherein the possible extraneous material includes large droplets.

6. The method of claim 5 further comprising controlling, around a desired value, a steam generation rate from said steam-generating liquid.

7. The method of claim 6, wherein said controlling of the steam generation rate further comprises using a feedback loop to controllably heat the steam-generating liquid while measuring the temperature of the generated steam so as to maintain a steam temperature of the steam-generating liquid around a pre-determined set point.

8. The method of claim 7 further comprising controlling, around a selectable desired value, a humidification delivery rate at a point of use of the humidified gas flow.

9. The method of claim 1 further comprising adjusting the selectable humidification delivery rate.

10. The method of claim 9, wherein said adjusting of the selectable humidification delivery rate comprises:

adjusting a pre-determined temperature set point accordingly;

providing said gas flow with an adjustable pressure; and adjusting said pressure accordingly.

11. The method of claim 10 further comprising causing the humidified gas flow to pass through an in-line filter to remove any possible extraneous material from the humidified gas flow.

12. The method of claim 1 further comprising removing condensation from the humidified gas flow before a point of use.

13. The method of claim 12 further comprising sensing a condensation level between a point of steam generation and the point of use of the humidified gas flow and, and when said condensation reaches a pre-determined level, draining the condensation from the humidified gas flow.

14. A system for near saturation humidification of a gas flow, the system comprises:

a chamber filled partially with steam-generating liquid up to a level controlled by an external sensor;

a heater immersed in said steam-generating liquid to generate steam, wherein, when a gas flow is injected into the chamber, the gas flow is mixed with the steam to produce a humidified gas flow; and a drain pipe controlled by a drain valve triggered by a condensation level sensor to remove condensation from the humidified gas flow.

15. The system of claim 14 further comprising an in-line filter to remove any possible extraneous material from the humidified gas flow.

16. The system of claim 15, wherein the possible extraneous material includes large droplets.

17. The system of claim 15, wherein said gas flow is made of air, Nitrogen or an inert gas.

18. The system of claim 15, wherein said gas flow is injected into a non-filled space above said steam-generating liquid in the chamber to be mixed with the steam from said steam-generating liquid.

19. The system of claim 18, wherein said steam-generating liquid is produced by the immersed heater controlled by a thermocouple attached to the chamber.

20. The system of claim 19, wherein said steam-generating liquid is essentially water.

21. The system of claim 14 further comprising a manifold device operatively connected to the chamber for supplying said gas flow, supplying said steam-generating liquid, injecting the steam into the gas flow and delivering the humidified gas flow to a point of use.

22. The system of claim 21, wherein said manifold device further comprises a liquid level sensor for sensing a liquid level within the chamber and a valve feed line, under a control of the liquid level sensor, for maintaining an adequate liquid level within the chamber.

23. The system of claim 22, wherein said chamber further comprises a generation rate control means for controlling, around a desired value, a steam generation rate from said steam-generating liquid.

24. The system of claim 23, wherein said generation rate control means further comprises a feedback loop to controllably heat the steam-generating liquid while measuring a temperature of the generated steam so as to maintain the steam temperature around a pre-determined set point.

25. The system of claim 23, wherein said feedback loop further comprises a heating device, in contact and for heating the steam-generating liquid, and a temperature measuring device in contact and for measuring the steam temperature.

26. The system of claim 25, wherein said heating device further comprises a replaceable heater cartridge.

27. The system of claim 25, wherein said temperature measuring device further comprises a thermocouple.

28. The system of claim 24 further comprising a humidification delivery rate control means for controlling, around a selectable desired value, a humidification delivery rate at the point of use of the humidified gas flow.

29. The system of claim 28, wherein said humidification delivery rate is made adjustable by having said humidification delivery rate control means that further comprises at least one of:

a. temperature set point adjusting means for adjusting said pre-determined temperature set point accordingly; or b. pressure set point adjusting means for providing said gas flow with an adjustable pressure and adjusting said pressure accordingly.

30. The system of claim 14 further comprising an extraneous material removing device for removing components, other than the steam and the flow gas, from the humidified gas flow.

31. The system of claim 30, wherein said extraneous material removing device further comprises an in-line filter for passing the steam and the flow gas while blocking other components of the humidified gas flow and allowing them to flow back to the steam-generating liquid.

32. The system of claim 14 further comprising a condensation removing device for removing condensation from the humidified gas flow before a point of use.

33. The system of claim 32, wherein said condensation removing device further comprises a drain pipe operatively attached to the manifold device between a point of steam generation and the point of use of the humidified gas flow, a condensation level sensor located with the drain pipe for sensing the condensation level and a drain valve for, when said condensation reaches a pre-determined level, draining the condensation.

* * * * *